United States Patent [19]

Wheeler

[11] 4,010,931

[45] Mar. 8, 1977

[54] DOOR LIFTING AND HOLDING TOOL

[76] Inventor: Lawrence Wheeler, 1500 Clevenger, Modesto, Calif. 95350

[22] Filed: Mar. 26, 1976

[21] Appl. No.: 670,962

[52] U.S. Cl. ..... 254/131

[51] Int. Cl.[2] ..... B66F 15/00

[58] Field of Search ..... 254/131, 132; 29/267

[56] References Cited

UNITED STATES PATENTS

| | | | |
|---|---|---|---|
| 1,234,243 | 7/1917 | Williams | 254/131 |
| 3,642,251 | 2/1972 | Niederholtmeyer | 254/131 |
| 3,833,997 | 9/1974 | Kaddatz et al. | 254/131 |
| 3,871,054 | 3/1975 | Schaefer | 254/131 |

*Primary Examiner*—Al Lawrence Smith
*Assistant Examiner*—Robert C. Watson
*Attorney, Agent, or Firm*—Robert D. Farkas

[57] ABSTRACT

A door lifting and holding tool which enables the user to lift and position a door with minimal amounts of effort comprising a frame member, a lever member pivotably affixed to a fulcrum means affixed to the frame, and means for elevating the frame above a supporting surface.

9 Claims, 4 Drawing Figures

DOOR LIFTING AND HOLDING TOOL

BACKGROUND OF THE INVENTION

1. The Field of the Invention

The present invention relates to lifting and holding tools, and more particularly, to a door lifting and holding tool.

2. Description of the Prior Art

The prior art includes several devices designed to lift doors, wallboard, or the like for positioning and installation. Most cannot be adjusted for different lifting heights and support the object lifted in only a small area of the bottom edge thereof, thereby courting the possibility of tilting or lateral slipage.

A panel lifting and supporting device is disclosed in the U.S. Pat. No. 2,692,753 to M. I. Masterson Jr. et al, issued Oct. 26, 1964 which includes a lever member having a fulcrum roller affixed to the underside thereof.

Further included in the prior art is the U.S. Pat. No. 2,989,286 to B. E. Gillespie issued June 20, 1961 which discloses a wall board lifter including an elongated plate adapted to have the user place his foot thereon and a fulcrum rim disposed on the underside of the plate and perpendicular to the longitudinal axis thereof.

The present invention overcomes the problems in the prior art by providing a door lifting and holding tool which includes means for varying the lifting heights thereof and means for contacting the door at more than one area on the bottom edge thereof.

SUMMARY OF THE INVENTION

Therefore, it is a primary object of the present invention to provide a door lifting and holding tool which includes means for varying the lifting height thereof.

A further object of the present invention is to provide means for contacting the lower edge of a door at more than one area thereof.

A still further object is to provide means for tilting a door at a desired angle during the lifting and the holding thereof.

Another object is to provide a door lifting and holding tool which is durable enough to be used for raising heavy core and lead shielded doors.

These objects, as well as further objects and advantages of the present invention, will become readily apparent after reading the description of a non-limiting illustrative embodiment and the accompanying drawings.

The present invention provides a door lifting and holding tool which includes a hollow frame member adapted to rest on a supporting surface. A portion of the frame member is adapted to be inserted under a door and engage the lower lateral edge thereof. A lever element is pivotally affixed to a fulcrum means which is affixed across the frame member and parallel to the door. The lower element includes a first end adapted to engage the door and a second end adapted to receive a human foot thereupon. As pressure is applied to the second end, the first end lifts the door effortlessly. Elevation means are affixed to the frame adjacent to the fulcrum means and provides means for adjusting the height that the door is lifted above the supporting surface. As the lever is stepped on it moves against the frame, and the frame and lever simultaneously support and hold the door. Furthermore, the lever may be slidably positioned along the fulcrum means providing for the tilting of the door at a desired angle to facilitate the positioning and fastening of hinges, pins, screws, or shims.

BRIEF DESCRIPTION OF THE DRAWINGS

In order that the present invention may be more fully understood it will now be described, by way of example, with reference to the accompanying drawings in which.

DESCRIPTION OF THE PREFERRED EMBODIMENT

Figure 1:
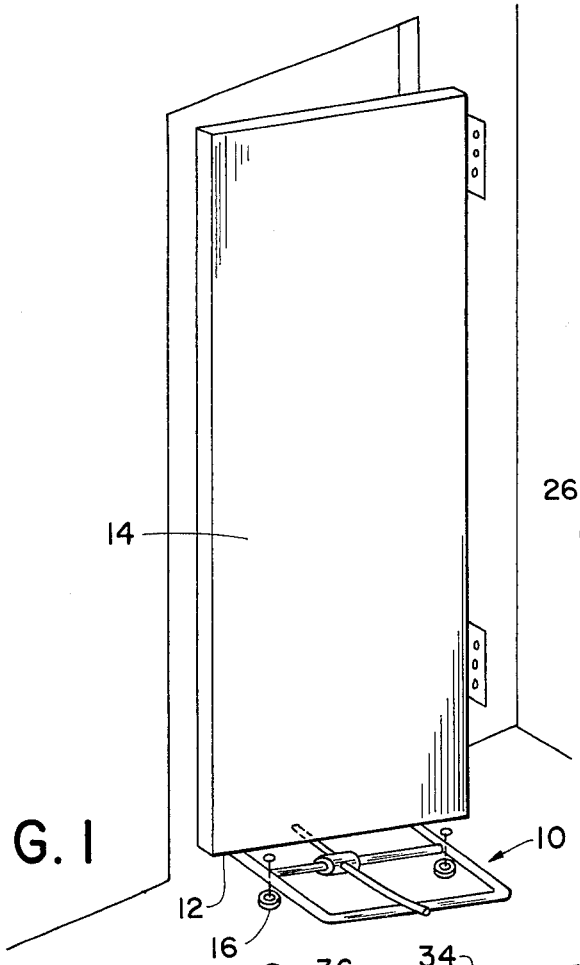
FIG. 1 illustrates a perspective view of the preferred embodiment of the present invention in position under a door.

Referring now to the Figures, and more particularly to FIG. 1, there is illustrated therein the preferred embodiment of the present invention, a door lifting and holding tool 10 which is in position under the lower lateral edge 12 of a door 14, the tool 10 resting on a supporting surface 16.

Figure 2:
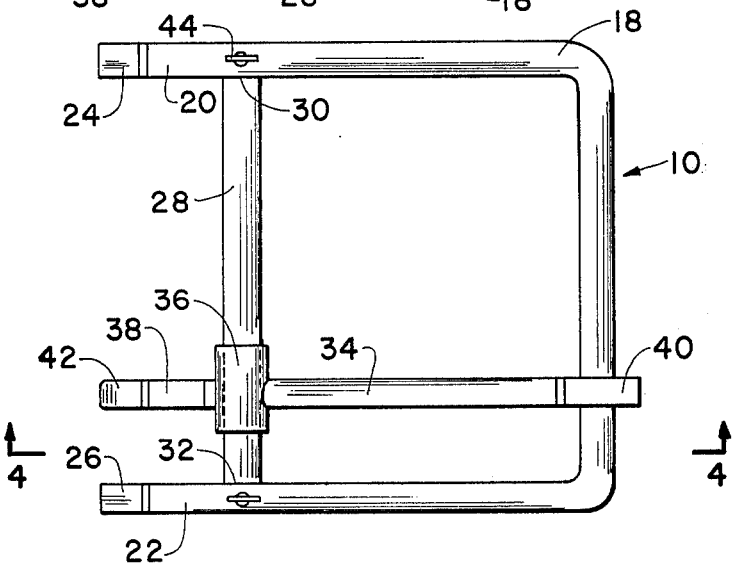
FIG. 2 illustrates a plan view of the preferred embodiment.

FIG. 2 illustrates the tool 10 which includes a hollow frame member 18 which is preferrably U shaped. The free ends 20 and 22 of the frame member 18 are flatened at 24 and 26 and are adapted to engage the edge 12. The frame member 18 preferably has a substantially circular cross-section. An elongated fulcrum means in the form of a bar element 28 having a substantially circular cross-section is affixed on the ends 30 and 32 thereof to the frame member 18 parallel to the edge 12 of the door 14 when the frame member 18 is placed thereunder.

Figure 4:
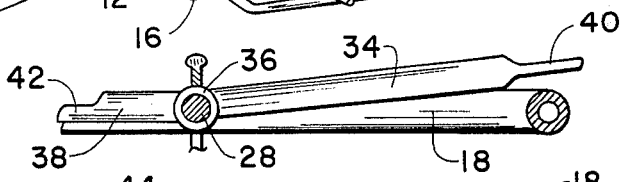
FIG. 4 illustrates a sectional view taken substantially along line 4—4 viewed in the direction of arrows 4—4 as shown in FIG. 2.

A lever element 34 is adapted to be pivotably affixed to the bar element 28 by a tubular portion 36 of the lever element 34. The longitudinal axis of the tubular portion 36 is perpendicular to the longitudinal axis of the lever element 34 and is parallel to the longitudinal axis of the bar element 28. The tubular portion 36 encircles the bar element 28 and is adapted to be slidably positioned therealong as shown in FIG. 4. A first end 38 of the lever element 34 is adapted to engage the lower lateral edge 12 and a second end 40 is adapted to receive a human foot thereupon. The first end 38 is preferably flatened at 42 to facilitate the engaging of edge 12.

Figure 3:
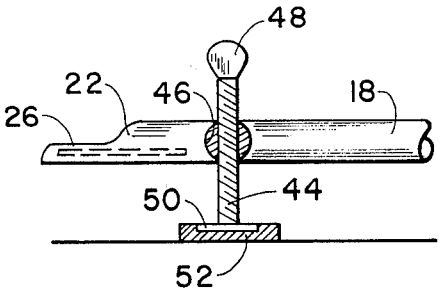
FIG. 3 illustrates a sectional front elevation view of a support element.

Elevation means in the form of a pair of supporting elements 44 are affixed to the frame member 18 adjacent to the ends 30 and 32 of the bar element 28. The supporting elements 44 and adapted to variably elevate the frame member 18 above the surface 16. The supporting elements 44 are adapted to threadably cooperate with a pair of apertures 46 disposed in the frame member 18 as shown in FIG. 3. The upper ends 48 of the supporting elements 44 are adapted to be manually turned by hand and the lower ends 50 and adapted to rest on the supporting surface 16. The longitudinal axes of the supporting elements 44 are preferably normal to the surface 16. The lower ends 50 preferably include resilient pads 52 affixed thereon. Pads 52 are preferably contructed of rubber.

In use, the ends 20 and 22 and the first end 38 are slid under the door 14 and engage the lower lateral edge 12. The supporting elements 44 are adjusted to a desired height by the rotation thereof. If the door is to be lifted straight up the lever element 34 is positioned midway between the ends 20 and 24. If the door is to be tilted during lifting the lever element 34 is placed closer to the side which is to be raised the highest. The user then steps on the second end 40 until it hits the frame member 18 and continues to put pressure on both until the frame member 18 rests on the supporting surface 16 thereby raising the door 14 to a desired height and angle.

It will be understood that various changes in the details, materials, arrangements of parts and operation conditions which have been herein described and illustrated in order to explain the nature of the invention may be made by those skilled in the art within the principles and scope of the invention.

I claim:

1. A door lifting and holding tool comprising:

a. a hollow frame member for resting on a supporting surface, a portion of said frame member dimensioned for insertion under and for engaging a portion of the lowermost edge of a door resting on said supporting surface;

b. elongated fulcrum means fixedly secured on the ends thereof to said frame member, whose the longitudinal axis of said elongated fulcrum means being substantially parallel to said lowermost edge;

c. a lever element being pivotably affixed to said fulcrum means and slidable along said longitudinal axis of said elongated fulcrum means, a first end of said lever element dimensioned to engage said lowermost edge of said door, a second end of said lever element for receiving a human foot thereupon;

d. elevation means affixed to said frame member adjacent to said ends of said fulcrum means, said elevation means enabling manual changes in the elevation of said frame member in relation to said supporting surface.

2. The door lifting and holding tool as claimed in claim 1 wherein said frame member comprises substantially a three sided rectangularly shaped frame, the free ends of said frame adapted to engage said lowermost edge.

3. The door lifting and holding tool as claimed in claim 2 wherein said free ends of said frame are adapted with a flatened portion thereat facilitating the engagement to said lowermost edge thereby.

4. The door lifting and holding tool as claimed in claim 1 wherein said first end is adapted with a flatened portion facilitating engagement with said lowermost edge thereby.

5. The door lifting and holding tool as claimed in claim 1 wherein said fulcrum means comprises a rod element having a substantially circular cross-section.

6. The door lifting and holding tool as claimed in claim 5 wherein said lever element is pivotably affixed to said rod element at a portion of the length of said lever element having a tubular cross-section, said longitudinal axis perpendicular to the length of said lever element, said portion encircling said rod element.

7. The door lifting and holding tool as claimed in claim 1 wherein said elevation means comprises a pair of supporting elements adapted to threadably cooperate with a pair of apertures disposed in said frame member, the upper end of said supporting elements adapted to rotate manually and the lower end of said supporting elements adapted to rest on said supporting surface.

8. The door lifting and holding tool as claimed in claim 7 wherein the longitudinal axes of said supporting elements are substantially normal to said supporting surface.

9. The door lifting and holding tool as claimed in claim 7 wherein said lower end further comprises a resilient pad fixedly secured therebelow.

* * * * *